United States Patent [19]

Lynch

[11] 4,140,302

[45] Feb. 20, 1979

[54] JET IMPINGEMENT COOLING DEVICE

[76] Inventor: Roland H. Lynch, Falcon Foundry Company, Sixth & Water Sts., Lowellville, Ohio 44436

[21] Appl. No.: 881,181

[22] Filed: Feb. 27, 1978

[51] Int. Cl.[2] ..... C21B 7/10; C21B 7/16

[52] U.S. Cl. ..... 266/270; 122/6.6

[58] Field of Search ..... 110/182.5; 122/6 B, 122/6.6; 266/189, 193, 194, 270

[56] References Cited

U.S. PATENT DOCUMENTS

| | | | |
|---|---|---|---|
| 182,621 | 9/1876 | Vielhaber | 122/6.6 |
| 840,195 | 1/1907 | Berry | 122/6 B |
| 2,891,783 | 6/1959 | Eberhardt | 122/6.6 |
| 3,840,219 | 10/1974 | Sheridan et al. | 110/182.5 |
| 3,926,417 | 12/1975 | Horio et al. | 122/6.6 |

FOREIGN PATENT DOCUMENTS

| | | | |
|---|---|---|---|
| 525930 | 3/1931 | Fed. Rep. of Germany | 266/270 |
| 152566 | 10/1920 | United Kingdom | 122/6 B |
| 454253 | 2/1975 | U.S.S.R. | 266/270 |

*Primary Examiner*—Gerald A. Dost

*Attorney, Agent, or Firm*—Buell, Blenko & Ziesenheim

[57] ABSTRACT

Blast furnace tuyeres and like hollow-walled cooling devices have one or more water inlet conduits in the wall formed with a terminal constriction so as to discharge cooling water as a high speed jet against the specially contoured inside surface of the nose preferably normal to the tuyere end. The jet impinges on that inside surface at a low angle and the surface is curved to change the direction of the jet preferably by 90° or more, so that the stream is held against the surface to be cooled not only by the force of the jet but also by centrifugal force.

11 Claims, 7 Drawing Figures

JET IMPINGEMENT COOLING DEVICE

This invention relates to water cooled articles for high temperature service such as tuyeres for blast furnaces, cupolas and like articles. It is more particularly concerned with such articles making enhanced use of water, in the form of jets, for cooling.

Tuyeres for blast furnaces, cupolas and similar furnaces are conventionally hollow-walled frusto-conical shaped castings positioned in the furnace wall so that air can be blown through the tuyere into the furnace hearth. Water is circulated within the tuyere wall to cool it and prevent it from being melted by the heat of the furnace. Tuyere coolers and cinder notch coolers are similar articles. Tuyere coolers are set into a furnace wall to receive the tuyeres. Cinder notch coolers are set in the slag or cinder tap hole and the hot slag is tapped out through them. Blast furnaces and other furnaces are also provided with cooling plates set in the furnace wall, generally around the hearth. Cooling plates are not frusto-conical but in plan are segments of a circle, usually the hearth circle of a furnace. A number of such plates arranged side-by-side form a jacket surrounding a furnace. The plates are hollow and, like tuyeres, are cooled internally with flowing water. Electrode contact shoes for electric furnaces are quite similar in structure to cooling plates. My invention to be described hereinafter is applicable to the hollow water cooled articles above mentioned and to other hollow cooling devices having an end or nose surface which must be maintained at a temperature below the melting temperature of the material, usually copper, of which it is constructed. My invention is described hereinafter with particular reference to blast furnace tuyeres, but my invention encompasses the other articles above mentioned.

In tuyere design many arrangements of water passages within the tuyere wall have been tried to increase the cooling effect of the water. As the nose of the tuyere is subjected to the highest temperatures, a circumferential nose chamber, partially or wholly partitioned from the body of the tuyere, has been quite widely employed, the cooling water being admitted first to the nose chamber and from that to the remainder of the tuyere body. Attempts have also been made to improve the cooling effect of the nose chamber by introducing the cooling water in a circumferentially directed stream intended to scour the chamber surface and so improve heat transfer thereacross.

A tuyere of that nature is disclosed in British patent No. 1,525,566 of Oct. 21, 1920 to C. O. Bower. A recent U.S. patent showing a similar device is U.S. Pat. No. 3,840,219 of Oct. 8, 1974 issued to A. T. Sheridan et al. U.S. Pat. No. 2,891,783 of June 23, 1959 issued to J. E. Eberhardt discloses a similar structure including a circumferentially directed water delivery conduit having a constricted opening so as to deliver the water in a jet of higher pressure and velocity than that of the water up stream thereof. Such tuyeres have not attained any considerable acceptance in the blast furnace field.

It is the principal object of my invention to provide tuyeres and other cooling devices which afford greatly improved cooling of their critical areas so as to multiply their average life by several times. It is another object to minimize the volume of cooling water required by such devices, thereby reducing pipeline friction loss, pumping and operating costs and also the capital investment required for pumps, motors, pipelines, valves and related equipment. It is another object to improve tuyere safety by cooling the tuyere with a low volume of water flow which, together with divided flow paths described hereinafter, reduce the hazards of water entering the furnace should tuyere failure occur. Still another object is to provide tuyeres with improved cooling capacity that are simple to operate, relatively inexpensive to manufacture and readily adaptable as replacements for all types and sizes of tuyere configurations currently in use, including two-compartment tuyeres.

I have discovered that the cooling of a tuyere or other water cooled device can be greatly enhanced by the judicious use of three constituent elements in proper combination. This combination consists of (1) the use of one or more high pressure, high velocity water jets, having nozzle velocities well in excess of 100 feet per second, (2) the direct impingement of those jets directly against the hottest surface and (3) the proper contouring of that surface in such a manner that the kinetic energy, centrifugal force and momentum of the jet streams magnify and intensify the contact pressure and hold the highest velocity water in forceful contact throughout the full extent of that surface. The high surface velocity and contact pressure greatly increase the effectiveness of the scrubbing action and increase the heat transfer from the hot surface to the water, thus optimizing the cooling effect for a given volume of water. I prefer to direct the high velocity jet or jets normally to the hot tuyere end which is contoured to change the direction of the jet by some 90° or so. However, in certain devices the discharge nozzle can be located at a low impingement angle of some 7° to 20° to the hot surface. I have also discovered that the negative pressure around a jet is highly detrimental to the scouring action of the jet and must be avoided or overcome. Hereinafter I disclose embodiments of my invention in which the positioning of the jet and the contour of the hot surface incorporate my discoveries above mentioned. These embodiments, which are presently preferred by me are illustrated in the attached figures, to which reference is now made.

Figure 1:
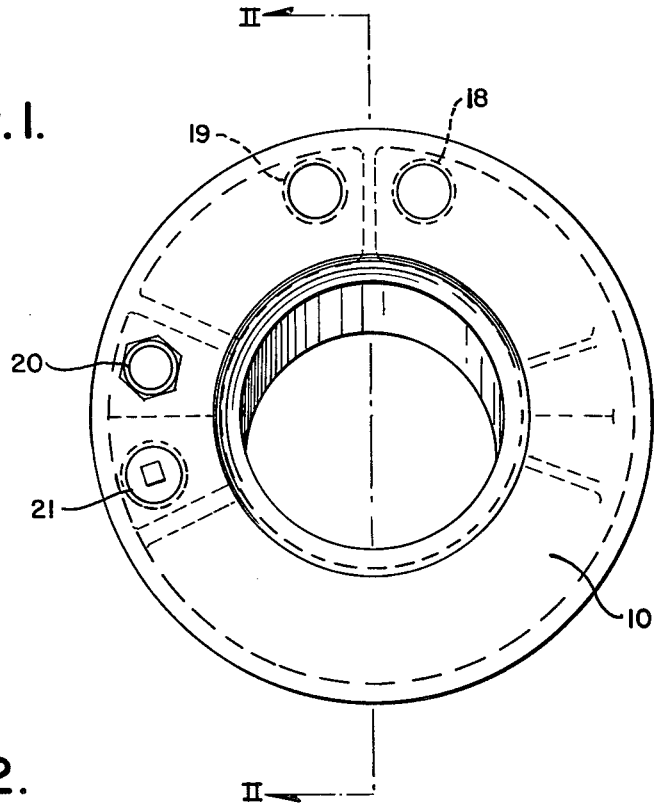
FIG. 1 is a butt end elevation of a tuyere comprising a first embodiment of my invention.
Figure 2:
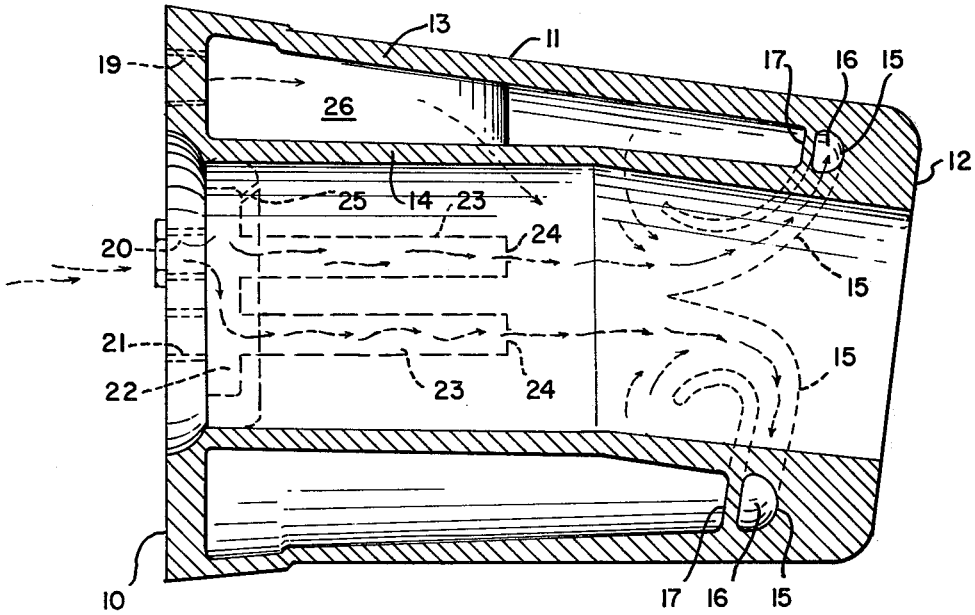
FIG. 2 is a longitudinal section of the tuyere of FIG. 1 taken on the plane II—II thereof.
Figure 3:
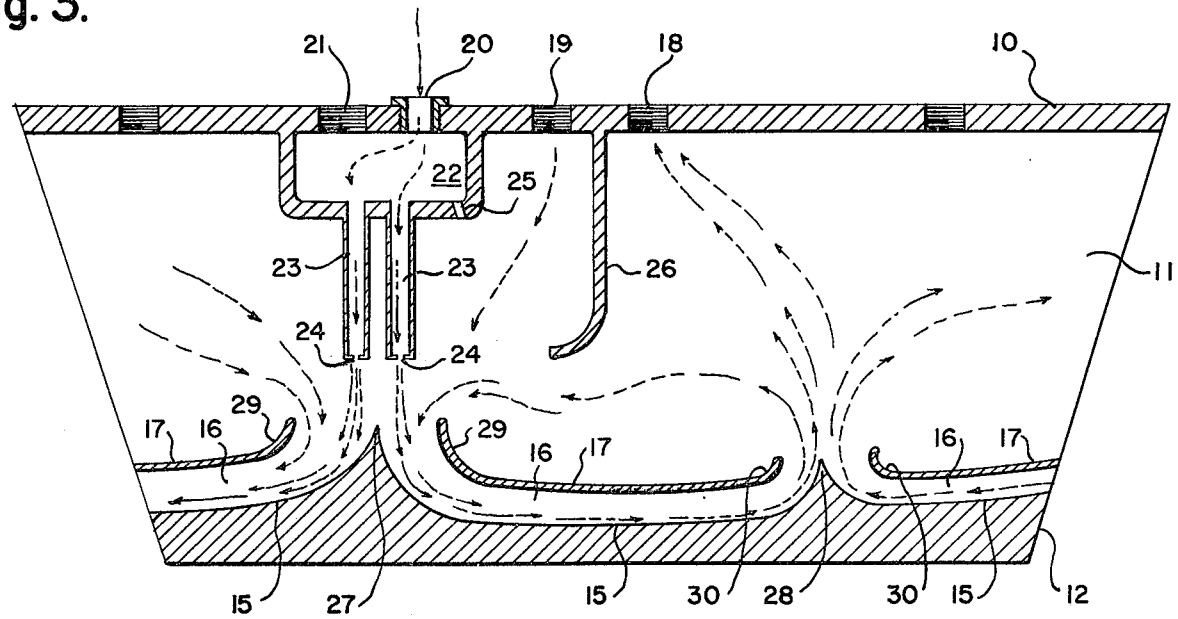
FIG. 3 is a plane development of a surface within the wall cavity of the tuyere of FIGS. 1 and 2.

In FIGS. 1, 2 and 3, the tuyere has a butt end 10, a body portion 11 and a nose 12, the nose 12 being of somewhat smaller diameter than butt end 10 and spaced therefrom by body portion 11. The latter comprises a frusto-conical outer wall 13 and a like inner wall 14 spaced from outer wall 13 so as to provide a circumferential chamber for cooling water. Spaced from the inside surface 15 of nose 12 is a baffle or partition 17, described in detail hereinafter, so as to form a nose chamber 16 for cooling water.

In butt end 10 is located a high pressure water inlet 20, preferably at the 9 o'clock position as is shown in FIG. 1 or at the 3 o'clock position, and an adjoining plugged access opening 21 for nozzle installation. Also in butt end 10 is located a water outlet 18 spaced circumferentially from water inlet 20, and an optional low pressure water inlet 19. Inlet 20 and access opening 21 open into a header chamber 22 from which a pair of water inlet conduits 23 extend axially of the tuyere toward the nose 12, but terminate intermediate butt end 10 and nose 12. Each of conduits 23 terminates in a constriction or nozzle 24.

The inside surface 15 of nose 12 is not uniformly spaced from the outside surface of nose 12 around its circumference. The contour of surface 15 is best understood from FIG. 3. Where the jets from conduits 23 impinge on surface 15 the latter curves symmetrically toward butt end 10, and at a location midway between the two inlet conduits 23 forms a cusp 27. Surface 15, at a location 180° removed from cusp 27, also curves symmetrically toward butt 10 to form a second cusp 28. Partition 17 is divided into two portions, each a duplicate of the other, paralleling surface 15 between cusps 27 and 28, but spaced therefrom. The ends of each segment of partition 17 are also curved toward butt end 10 in opposite senses at 29 and 30, respectively, so as to form with surface 15 a pair of open-ended but otherwise closed nose compartments or chambers 16, each extending circumferentially around the tuyere body 11 adjacent nose 12. The open ends of those compartments are appreciably greater in cross-sectional area than the constrictions or nozzles 24 of conduits 23. An optional channel 25 may be provided through the wall of header compartment 22 and an optional longitudinal partition 26 may be provided between low pressure water inlet 19 and water outlet 18.

In the operation of the first embodiment of my tuyere above described, high pressure water, on the order of 140 to 180 pounds per square inch, is introduced through inlet 20. The nozzles or constrictions 24 of water inlet conduits 23 are dimensioned to deliver the water introduced at the pressures above mentioned as jets having a velocity of 150 feet per second or more. Those jets impinge on the oppositely curved sides of cusp 27, are changed in direction by 90°, and are directed onto the specially shaped inner nose walls 15 whose curvature is such that the centrifugal force, the kinetic energy and momentum of the water jets hold the water flow in forceful scrubbing contact with the inner nose wall surface 15 throughout the length of the passage 16, from which the flow is returned to the body compartment. The jets from constrictions 24 aspirate the surrounding water in the tuyere body 11 at a rapid rate and carry it along through the passage 16. The water, after extracting heat from the nose 12 and tuyere body 11, exits through outlet 18.

FIG. 3 indicates how the thin stream of rapidly moving water scrubs the inner nose wall 15 and is held in contact by the kinetic energy and centrifugal force following the curvature of the inner nose wall 15 thus keeping contact velocity and contact pressure at a maximum throughout the length of the nose passage 16.

The constrictions 24 of inlet conduits 23 are spaced from the entry openings of nose compartments 16 so that the negative pressure region surrounding each jet, which extends only several diameters from the constriction, is remote from the hot inner surface 15 of nose 12. Thus the scouring of surface 15 by the water jets is not impaired by those negative pressure regions.

FIGS. 1, 2 and 3 illustrate an embodiment comprising two inlet conduits 23 and two portions of nose compartment 16. It will be understood that my invention also comprises tuyeres having only one inlet conduit and a single nose compartment extending circumferentially of the tuyere, as well as tuyeres having more than two inlet conduits. My invention is applicable to double compartment tuyeres as well as the single compartment tuyere in the figures.

Figure 4:
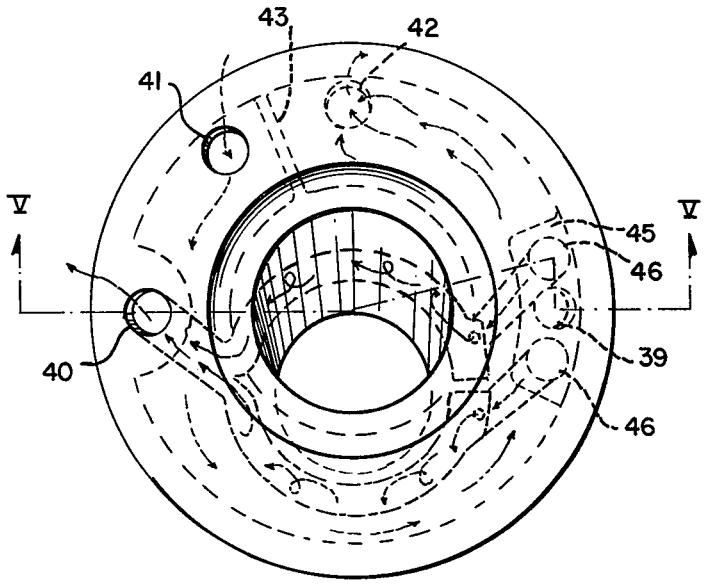
FIG. 4 is a butt end elevation of a tuyere comprising a second embodiment of my invention.
Figure 5:
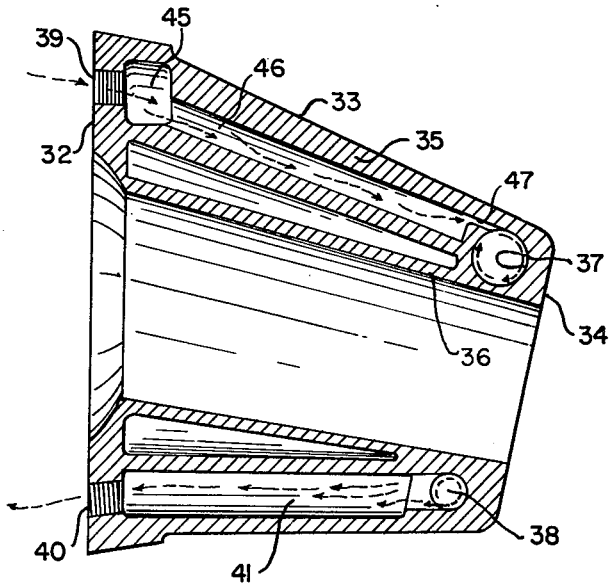
FIG. 5 is a longitudinal section taken on the plane V—V of FIG. 4.

FIGS. 4 and 5 illustrate a second embodiment of my invention which is likewise applicable to single compartment or double compartment tuyeres. The tuyere of the figures has a butt end 32, a body portion 33, and a nose 34. The body 33 comprises an outer frusto-conical wall 35 and an inner wall 36. The nose 34 has an inner surface 37 forming a portion of the wall of a circumferential nose compartment 38. In butt end 32 are a high-pressure water inlet 39 and a high-pressure outlet 40 spaced circumferentially therefrom, a low-pressure water inlet 41 and a low-pressure outlet 42 adjacent each other but separated internally of tuyere body 33 by radial partition 43, which extends between outer wall 35 and inner wall 36 the full length of the tuyere body up to nose compartment 38. High-pressure water inlet 39 opens into a header chamber 45, from which two adjoining but spaced water inlet conduits 46 extend axially of tuyere body 33 to nose compartment 38. They discharge into that compartment through constrictions or nozzles 47. The nose compartment 38 is continuously curved, circular in cross section as is shown in FIG. 5, and nozzles 47 are tangent to the cross section of nose compartment 46 adjacent the junction of nose 34 with outer wall 35 of tuyere body 33. Nose compartment 38 communicates with high-pressure water outlet 40 through a conduit 41.

The high-pressure water from inlet conduits 46 is discharged through the constrictions or nozzles 47 as high velocity jets which impinge on the curved inner surface 37 of nose 34, the hottest portion of nose compartment 38. The direction of travel of the jets is thus changed through 90° and the jets spiral around the wall of chamber 38 in opposite circumferential directions and exit through outlet conduit 40.

The centrifugal force developed by the spiralling jet streams overcomes the negative pressure around the jet and holds the rapidly moving water in close contact with the surface of nose compartment 38.

The water introduced through inlet 41 circulates within the body of the tuyere rearward of nose compartment 38 and is drawn off through outlet 42. This water may be introduced at a lower pressure than the water entering through inlet 39, or it may be introduced at same pressure. As before, the water entering inlet 39 should be at a pressure on the order of 140 to 180 pounds per square inch. The nozzles or constrictions 47 are dimensioned to deliver that water as jets having a velocity of about 150 feet per second.

While I prefer to use a pair of inlet conduits 46 disposed as above described, my invention comprehends tuyeres with one such conduit, as well as tuyeres with more than two conduits. The nose compartment 38 is of circular cross section as above described.

Figure 6:
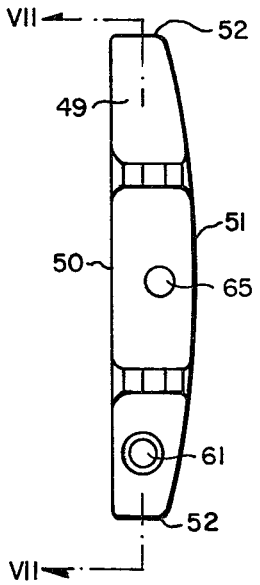
FIG. 6 is a plan of a cooling plate.
Figure 7:
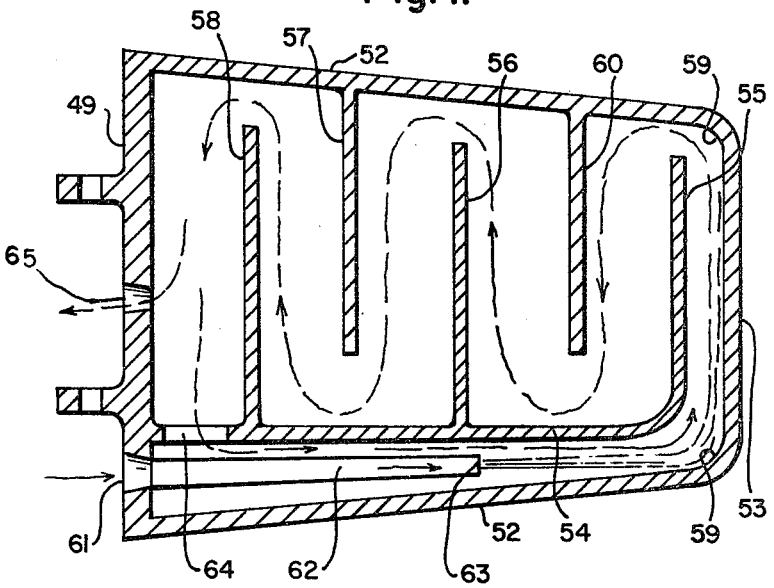
FIG. 7 is a cross section through the cooling plate of FIG. 6 on the plane VII—VII thereof.

FIGS. 6 and 7 illustrate my invention as applied to a cooling plate. The cooling plate has a flat butt surface 49, flat bottom surface 50, curved top 51, and narrow sidewalls 52 connecting bottom surface 50 and top surface 51, and a relatively flat nose wall 53 joining sidewalls 52 in curved portions 59 at each end. Within the hollow interior of the plate, a flat baffle 54 extends from butt 49 near one side 52 toward the nose 53, joining bottom surface 50 and top surface 51. Baffle 54 joins a baffle 55 positioned at right angles thereto and spaced from nose 53. Baffles 55 also join surfaces 50 and 51. Baffle 55 ends short of sidewall 52 more distant therefrom. From that sidewall 52 a baffle 60 extends parallel to baffle 55 but spaced therefrom toward butt surface 49, filling the space between bottom 50 and top 51, and stopping short of baffle 54. From baffle 54 and remote sidewall 52 extend baffles 56, 57 and 58 alternately, spaced from each other so as to form a folded passage from nose 53 to butt 49 of the cooling plate. An inlet port 61 in butt surface 49 opens into the space between baffle 54 and its adjacent sidewall 52 and an exit port opens out of butt surface 49 between baffle 54 and remote sidewall 52. A tube 62 extends within the cooling plate from inlet 61 to a position intermediate top surface 49 and nose 53, having its open end 63 constricted so as to form a nozzle. An aperture 64 in baffle 54 communicates with the space between top 49 and baffle 58.

The operation of the cooling plate of FIGS. 6 and 7 is evident from the description of the embodiments of FIGS. 1–5. Water from nozzle 63 is jetted against a curved wall portion 59 of the inside nose wall 53 at pressure sufficient to turn it 90° against curved surface 59 and across the inside surface of wall 53 against the curved surface 59 on the opposite side. From there the water passes back to outlet port 65, loosing velocity. The jet stream is held in intimate contact with the inside surface of wall 53 throughout its length by the force of the jet and the centrifugal force of the jet stream generated during its change of direction. The water near outlet port 65 is aspirated through passage 64 and the channel between sidewall 52 and baffle 54 by the jet from nozzle 63, thus being recirculated.

The improvement in tuyere life in a blast furnace equipped with tuyeres of my invention as shown herein in FIGS. 1–3 is striking. A blast furnace with which I am familiar required tuyere replacement at the rate of some 200 to 230 conventional tuyeres per year. An experiment was carried out on this furnace with my tuyeres, which exhibited a life corresponding to tuyere replacement at the rate of only 40 per year. This almost six-fold improvement represents a savings in copper costs of about $85,000 per year and an increase in iron production due to reduced down time for tuyere changing of about 14,000 tons per year.

In the tuyeres of my invention above mentioned the water volume per tuyere was about 70 gallons per minute which, as has been mentioned, produced a jet velocity of about 150 feet per second or more. In an effort to improve cooling conventional double compartment tuyeres in furnaces with which I am familiar have been supplied with water at rates up to 150 gallons per minute but with results much inferior to those obtained with my tuyeres.

Summarizing, the most pertinent features of my invention which are itemized in the following claims are the properly oriented and direct intense impingement of a very high velocity water jet or jets of controlled volume and velocity directed against the critically heated surface which has been so shaped or oriented as to efficiently utilize the kinetic energy, centrifugal force and momentum of the jet stream to increase and maintain the contact pressure and intensify the scrubbing action of the water against the heated surface over the full length of the water passage and thus significantly increase the water-side heat transfer coefficient for optimum cooling.

In the foregoing specification I have described presently preferred embodiments of my invention, however, it will be understood that my invention can be otherwise embodied within the scope of the following claims.

I claim:

1. A water-cooled device comprising a hollow wall body having a nose and a base, a water inlet in the base, a conduit within the hollow wall extending from the water inlet toward the nose, a water outlet in the base spaced from the water inlet, a terminal constriction in the water inlet conduit whereby water discharges therefrom toward the nose and normal thereto in a jet at a velocity greater than that in the water inlet, the inside of the nose being contoured so that the jet impinges on a curved surface thereof at a low angle thereto and has its direction changed approximately 90° thereby, thus scouring the inside of the nose.

2. Apparatus of claim 1 in which the device is circular in cross section and the inside of the nose is further contoured to cause the jet to travel circumferentially thereof.

3. Apparatus of claim 1 in which the constriction in the water inlet conduit is dimensioned to convert a known volume of water introduced at a pressure from about 140 to 180 pounds per square inch into a jet having a velocity of about 150 feet per second.

4. Apparatus of claim 1 in which the discharge end of the water inlet conduit is positioned intermediate the base and nose to space the negative pressure area around the emerging jet from the nose.

5. Apparatus of claim 1 including a plurality of water inlet conduits within the hollow wall, each of which conduits having at least one said constriction therein whereby incoming water is converted into a series of jets so oriented as to impinge the jet stream intensely onto the inner nose surface and the inner surface of the hollow wall thus scouring those surfaces.

6. Apparatus of claim 2 in which the curved surface of the nose is curved toward the base in the jet impingement region, and the further contour of the nose comprises a surface spaced circumferentially from the jet impingement region curved toward the base in the opposite sense to that of the jet impingement region.

7. Apparatus of claim 6 including a second water inlet conduit having a constriction therein and in which the curved surface of the nose is curved toward the base in the jet impingement region of the second inlet conduit and curved toward the base in the opposite sense at a location spaced circumferentially of the nose from the second conduit, the curved nose surfaces in the impingement regions of the jets forming a cusp, and the conduits being spaced one on each side of that cusp.

8. Apparatus of claim 6 including a radial partition within the hollow wall spaced from the inside of the nose beween its curved portions so as to form an open ended but otherwise closed nose compartment extending at least partially around the device.

9. Apparatus of claim 8 in which the open ends of the nose compartment are greater in area than the conduit constriction so that the jet aspirates water from within the hollow wall and carries it through the nose compartment.

10. Apparatus of claim 2 in which the inside of the nose is contoured into a circumferential nose chamber partitioned from the remainder of the body and having a circular cross section, the water inlet conduit communicates with the nose chamber through a constricted passage tangent to the cross section of that chamber and adjacent an outer wall surface, whereby the jet scours the surface of the nose chamber spirally toward the water outlet.

11. Apparatus of claim 10 including a second water inlet conduit which communicates with the nose chamber through a constricted passage tangent to the cross section of that chamber and adjacent an outer wall surface, whereby the jet from the second water inlet conduit scours the surface of the nose chamber spirally toward the water outlet in the opposite direction from that of the jet from the first water inlet conduit.

* * * * *